US007798925B2

(12) United States Patent
Brodmann

(10) Patent No.: US 7,798,925 B2
(45) Date of Patent: Sep. 21, 2010

(54) DOUBLE-SIDED PING PONG PADDLE

(76) Inventor: Robert A. Brodmann, 131 Marks Pl., North Bergen, NJ (US) 07047

( * ) Notice: Subject to any disclaimer, the term of this patent is extended or adjusted under 35 U.S.C. 154(b) by 0 days.

(21) Appl. No.: 12/389,225

(22) Filed: Feb. 19, 2009

(65) Prior Publication Data

US 2009/0209373 A1 Aug. 20, 2009

Related U.S. Application Data

(60) Provisional application No. 61/029,959, filed on Feb. 20, 2008.

(51) Int. Cl.
*A63B 59/00* (2006.01)

(52) U.S. Cl. ..... 473/527

(58) Field of Classification Search ..... 473/518, 473/524, 527, DIG. 174; D21/732
See application file for complete search history.

(56) References Cited

U.S. PATENT DOCUMENTS

| | | | | |
|---|---|---|---|---|
| 1,930,281 | A | 10/1933 | Ogden | |
| 2,987,316 | A | 6/1961 | Butera | |
| D256,939 | S * | 9/1980 | Castelli | D21/732 |
| 4,227,692 | A | 10/1980 | Castelli | |
| D257,867 | S * | 1/1981 | Castelli | D21/732 |
| 4,368,890 | A | 1/1983 | Horstman et al. | |
| 4,387,895 | A * | 6/1983 | Steel | 473/518 |
| 4,516,774 | A * | 5/1985 | Nankivell | 473/518 |
| 4,900,022 | A | 2/1990 | Maggio | |
| 5,431,394 | A | 7/1995 | Stewart | |
| 5,549,294 | A | 8/1996 | Wellen | |
| 5,839,979 | A * | 11/1998 | De Genty | 473/518 |
| 7,273,429 | B2 * | 9/2007 | Watson et al. | 473/527 |
| 2002/0098923 | A1 * | 7/2002 | Reynolds et al. | 473/518 |
| 2007/0021243 | A1 * | 1/2007 | Fourie | 473/518 |
| 2009/0209373 | A1 * | 8/2009 | Brodmann | 473/527 |

FOREIGN PATENT DOCUMENTS

| | | | |
|---|---|---|---|
| JP | 06039062 A * | 2/1994 | |

* cited by examiner

*Primary Examiner*—Raleigh W. Chiu
(74) *Attorney, Agent, or Firm*—Lucas & Mercanti, LLP

(57) ABSTRACT

A paddle, including a pair of lateral members connected by a mounting structure which extends transversely between the lateral members and is spaced proximately equivalent to the height of a player's hand, from the palm to the back of the hand. The height of the mounting structure is configured to provide a glove-like fit to the player's hand to allow for fast and easy transition from a forehand to a backhand and to provide more direct control of a ball during play.

19 Claims, 9 Drawing Sheets

DOUBLE-SIDED PING PONG PADDLE

This application claims the priority of U.S. Provisional Application No. 61/029,959 filed Feb. 20, 2008.

FIELD OF THE INVENTION

This invention generally relates to a paddle used for playing table tennis, which is commonly referred to as ping pong. More particularly, the invention relates to a double-sided paddle in which a user's hand glides in between to hold the paddle and to allow for more direct control of a ball during play.

BACKGROUND OF THE INVENTION

Table tennis is a relatively young sport that originated in the early 1800's by British Army officers that used lids from cigar boxes as paddles, rounded corks from wine bottles as balls and a row of books aligned across the middle of a table to form a "net." Later, hollow celluloid, or plastic, balls were used in place of rounded cork balls. The name "ping pong" derived from the sound made when the hollow celluloid balls hit the paddle and then hit the table.

With the growing popularity of ball games which a ball or other game projectile is struck by a paddle, various paddle configurations have been developed to provide better control of the ball during play. Conventional paddles commonly use a flat panel, which is fixed to a handle. A player's fingers wrap around the handle to hold the paddle in a bat-like manner. This configuration provides marginal ball control as the player swings the paddle at the ball. Players often wrap their hand around the flat panel to obtain more direct control of the ball. The disadvantage to using conventional paddles in this way is that the transition from forehand to backhand is difficult.

An improvement to the bat-like paddle was the two-sided bat or racquet shown in U.S. Pat. No. 1,930,281. This invention included two independent striking surfaces supported by a pair of parallel stays. A central handle extended transversely between the stays. The disadvantage to using this invention was that a player's fingers were wrapped around the handle in a fist-like manner to hold the paddle similar to conventional paddles.

The paddle of U.S. Pat. No. 2,987,316 completely eliminated the handle of a conventional type of a table tennis or ping pong paddle. This invention included a pair of spaced oppositely facing paddles connected by a pair of spacers extending between the paddles which were used for receiving the finger portion of a hand. The paddle received a player's hand in a flat or extended position. The disadvantage to using this invention was that the paddle relied on a frictional engagement with the palm and back of the hand for mounting the paddles on a player's fingers.

It is desirable to configure a double-sided ping pong paddle that allows a player's hand to glide in between opposing panels for ease of use and fast transition from forehand to backhand, but to provide a stop for the player's thumb and fingers to hold the paddle with the palm of his or her hand in a flat position.

SUMMARY OF THE INVENTION

It is therefore an objective of this invention to provide a double-sided table tennis or ping pong paddle.

It is a further object of this invention to provide such a double-sided table tennis or ping pong paddle that guides a player's hand into proper alignment to be received by the interior of the paddle.

It is yet a further object of this invention to provide such a double-sided table tennis or ping pong paddle which is configured to provide a glove-like fit to a player's hand to allow for fast and easy transition from forehand to backhand and to provide more direct control of the ball during play. The paddle will also eliminate vibrations which commonly occur when hitting a ball off-center.

This invention features a pair of lateral members spaced proximately equivalent to the height of a player's hand, from the palm to the back of the hand. Both lateral members are similar in configuration, although the invention does not preclude different sized members for the forehand or the backhand members, as the player finds useful. The lateral members have an outer circumference and an arched relief at the end closest to where the player's hand is received to provide clearance for the player's wrist, although the invention does not preclude other shapes as the player finds useful. Each lateral member further comprises a striking surface, which may have a grit exterior or rubber coating similar to table tennis or ping pong paddles of conventional design.

A mounting structure extends transversely between the spaced lateral members on the interior side opposite the striking surface to connect and fix the lateral members with respect to one another. The mounting structure can be oriented parallel to or traverse to, the longitudinal axis of the paddle. The mounting structure is preferably made of molded wood, although the invention does not preclude the mounting structure from being made using different materials such as metal, plastic, carbon fiber, rubber or epoxy resin. In a preferred embodiment, the mounting structure is contoured such that spaced lateral members diverge forming a V-shaped guide. More broadly, the pair of spaced lateral members have longitudinal axes, which diverge forming a V-shaped guide. The invention, as intended, comprises of multiple diverging angles, including parallel members, as the player finds useful, to accommodate the player's hand. Suitable vertical distances between the spaced lateral members on the interior side opposite the striking surfaces to accommodate different sized hands include about 1.1 inches (28 mm) at the fingertip end of the paddle and about 2.2 (56 mm) at the wrist end of the paddle for large thickness hands; about 1 inch (26 mm) at the fingertip end of the paddle and about 2 inches (52 mm) at the wrist end of the paddle for medium thickness hands; and about 0.95 inches (24 mm) at the fingertip end of the paddle and about 1.9 inches (48 mm) at the wrist end for small thickness hands.

The height of the mounting structure is configured to provide a glove-like fit to the player's hand to allow for fast and easy transition from forehand to backhand, and to provide more direct control of the ball during play. The mounting structure is preferably offset laterally of the centerline of the spaced lateral members to allow the player's hand to glide in between the lateral members. The mounting structure can also be transverse to the longitudinal axis of the paddle and positioned at the fingertip end of the paddle.

Preferably, a thumb grip is integrated with a longitudinally oriented mounting structure to provide a grip for the player's thumb for holding the paddle. One advantage of this mounting structure with the thumb grip is that the paddle is easily adaptable for left-handed or right-handed play. Another advantage to using the invention is that the paddle does not rely on a frictional engagement with the palm and back of the hand for mounting the paddles on the player's fingers.

In a preferred embodiment, the spaced lateral members are fastened to the mounting structure using glue/adhesive; although other methods of attachment such as screws, dowels, rivets and epoxies can be used and are considered within the scope of the invention. Conventional wood glues are suitable.

An ergonomically shaped thumb grip is separate from, or more preferably integrated with, a longitudinally oriented mounting structure at the end of the paddle where the player's hand is received. In the preferred embodiment, the thumb grip is preferably molded into the mounting structure, although the invention does not preclude a separable thumb grip made of different materials such as plastic, rubber, leather, fabric or metal. In the preferred embodiment, the thumb grip is sized to accommodate players' thumbs of different sizes.

Another embodiment of the paddle includes a pinky stop proximately located offset laterally of the centerline of the space lateral members opposite s longitudinal oriented mounting structure. The pinky stop provides an additional constraint feature for the player's hand opposite the thumb grip and nearest the pinky finger. The pinky stop can be of multiple configurations including, but not limited to, an elliptical or rectangular shape.

A further embodiment of the paddle comprises the spaced lateral members and a transversely oriented mounting structure manufactured as a single unit using a method such as an injection molded plastic, a rubber process or molded carbon fiber, wood or metal. In the single unit design, the mounting structure is preferably positioned at the finger tip end of the paddle, transverse to the longitudinal axis of the paddle and a finger hole is proximately located in the mounting structure, which is opposite the end where the player's hand is received into the paddle.

In a still further embodiment of the single-piece paddle, a hand grip is proximately located on the interior side of one of the spaced lateral members opposite the striking surface. The hand grip is sized to accommodate players hands of different sizes. The hand grip is preferably a leather band although other fabrics and materials, such as elastic, are considered within the scope of the invention. In the preferred embodiment, the hand grip is fastened to the outer circumference of the spaced lateral member using tacks. Other methods of attachment such as staples, adhesives or epoxy resin are viable means of fastening the hand grip to the space lateral member. An integral hand grip molded directly into the spaced lateral member during the fabrication process is also considered within the scope of the invention. Alternately, a replaceable hand grip attached to the spaced lateral member by means of a slip fit joint or hook and loop fastener means is considered within the scope of the invention.

In still a further embodiment of the single-piece paddle, an ergonomically shaped thumb grip connects the lateral members on the interior side opposite the striking surface to connect the lateral members and is proximately located at the end of paddle where the player's hand is received. The thumb grip is preferably a molded dowel made of the same material as the spaced lateral members, although the invention does not preclude different materials such as metal, plastic, carbon fiber, rubber or epoxy resin. In the preferred embodiment, the thumb grip is molded integrally with the spaced lateral members during the fabrication process. Alternatively, a separable thumb grip, which is fastened to the spaced lateral members using screws, dowels, rivets, adhesives and epoxies, can be used and is considered within the scope of this invention.

In another embodiment of the invention, the first lateral member and second lateral member are connected by the mounting structures extending transversely between the spaced lateral members on the interior side opposite the striking surfaces and are located at the fingertip end of the paddle. In this embodiment, the mounting structure is a wooden dowel proximately located at the fingertip end of the paddle, the end of the paddle opposite the end where the player's hand is received. A thumb grip also connects the lateral members on the interior side opposite the striking surfaces and is proximately located at the end of paddle where the player's hand is received. The thumb grip is offset laterally of the centerline of the lateral members to provide a grip for the player's thumb. The thumb grip is preferably a wooden dowel, although the invention does not preclude different materials such as plastic, rubber or metal. In the preferred embodiment, the thumb grip is taller than the mounting structures such that the spaced lateral members diverge forming a V-shaped guide. The height of the thumb grip and the mounting structures are configured to provide glove-like fit to the player's hand.

These and other advantages of the invention are apparent from the following detailed description and drawings.

DETAILED DESCRIPTION OF THE PREFERRED EMBODIMENT

Figure 1:
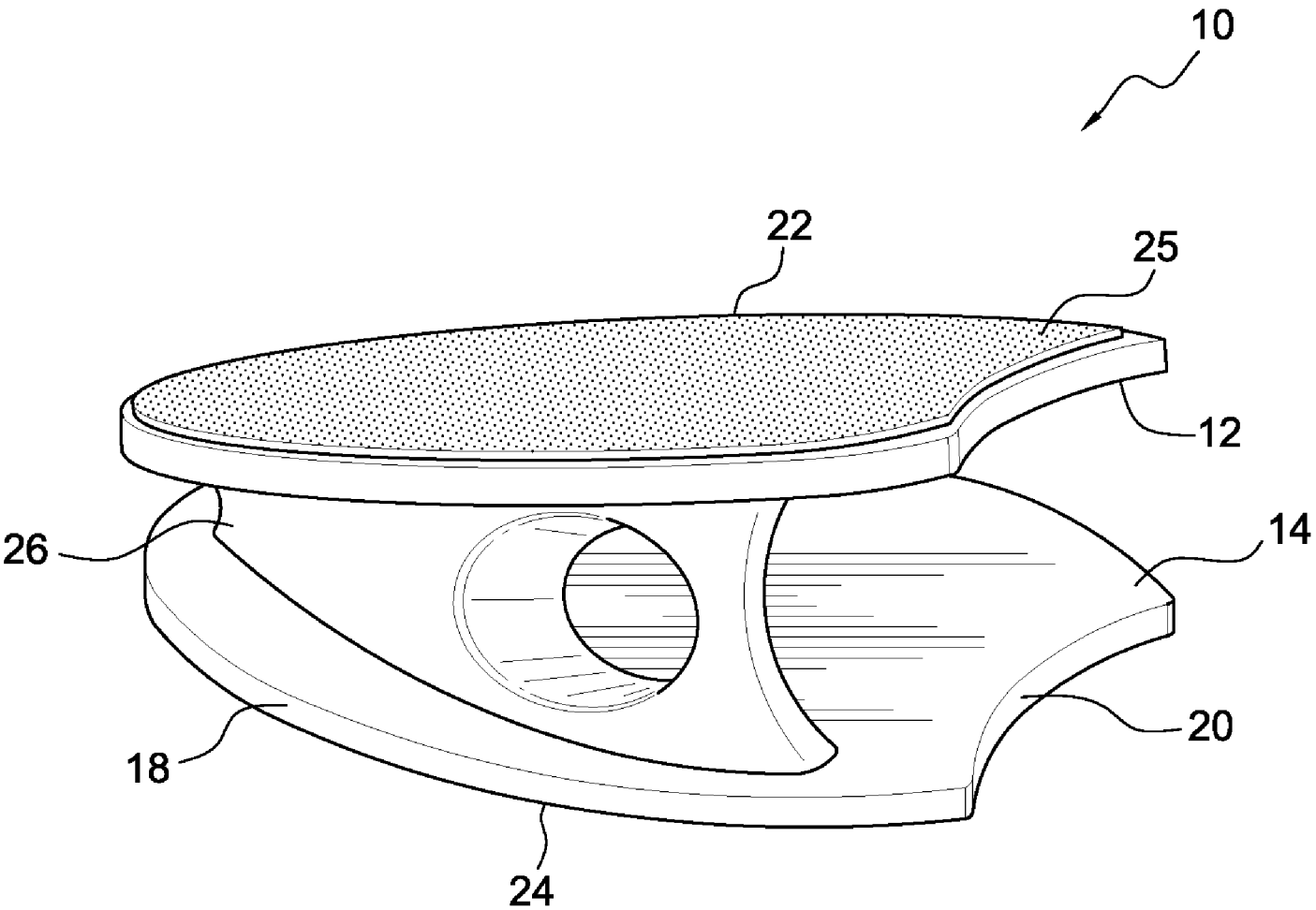
FIG. 1 is a perspective view of the paddle of the subject invention.
Figure 3:
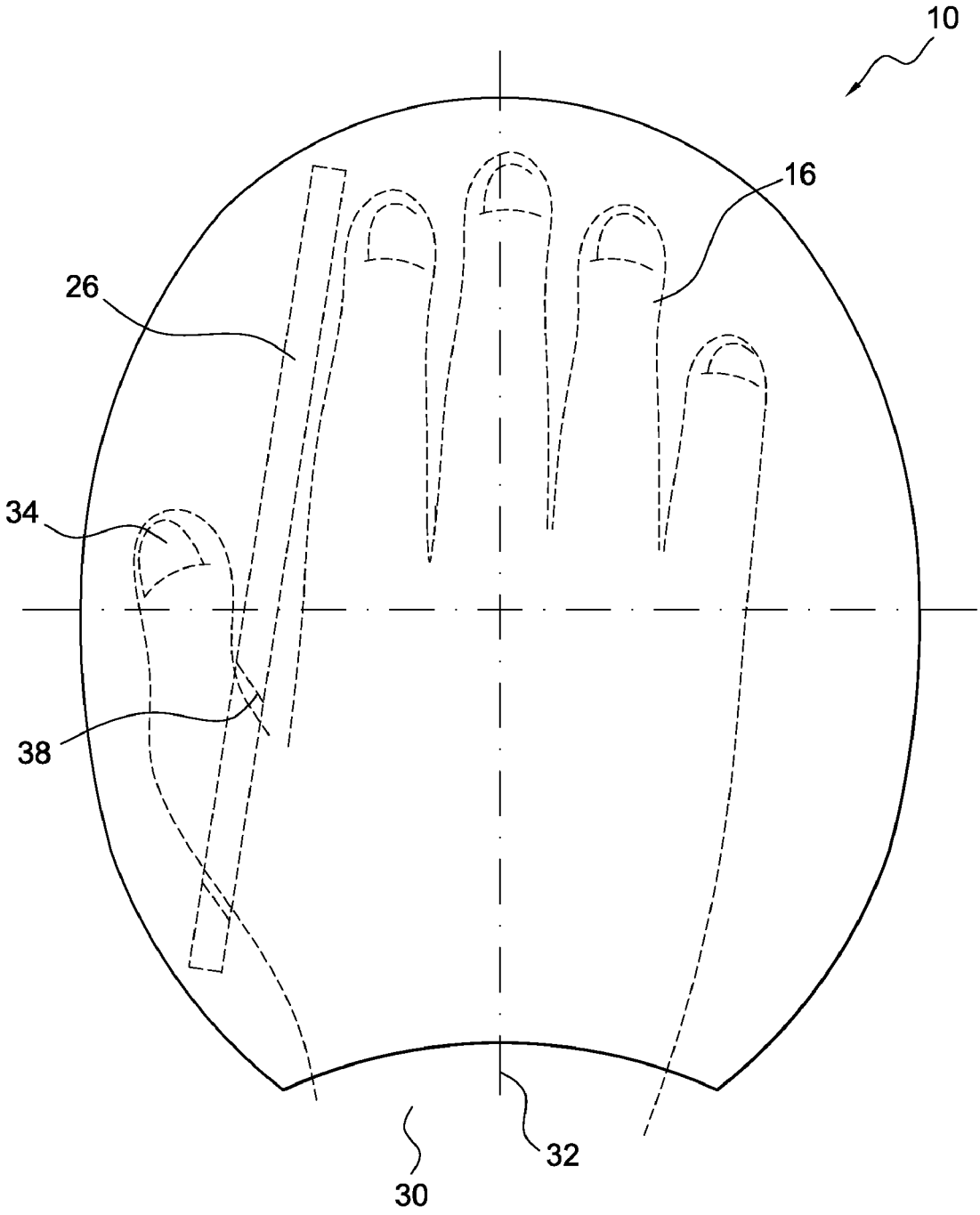
FIG. 3 is a top view of the paddle shown in FIG. 1 with the player's hand received by the paddle.

FIG. 1 illustrates an embodiment of the invention wherein a paddle 10 is comprised of a first lateral member 12 and a second lateral member 14 spaced proximately equivalent to the height of a player's hand 16, FIG. 3, from the palm to the back of the hand. The members 12, 14 are similar in configuration, although the invention does not preclude different sized members 12, 14 for the forehand or the backhand members, as the player finds useful. The members 12, 14 have an outer circumference 18 and an arched relief 20 at the end closest to where the player's hand 16 is received to provide clearance for the player's wrist as shown in FIG. 3, although the invention does not preclude other shapes as the player finds useful. Each member 12, 14 further comprises striking surfaces 22, 24 which may have a grit exterior or rubber coating 25 such as table tennis or ping pong paddles of conventional design.

Figure 2:
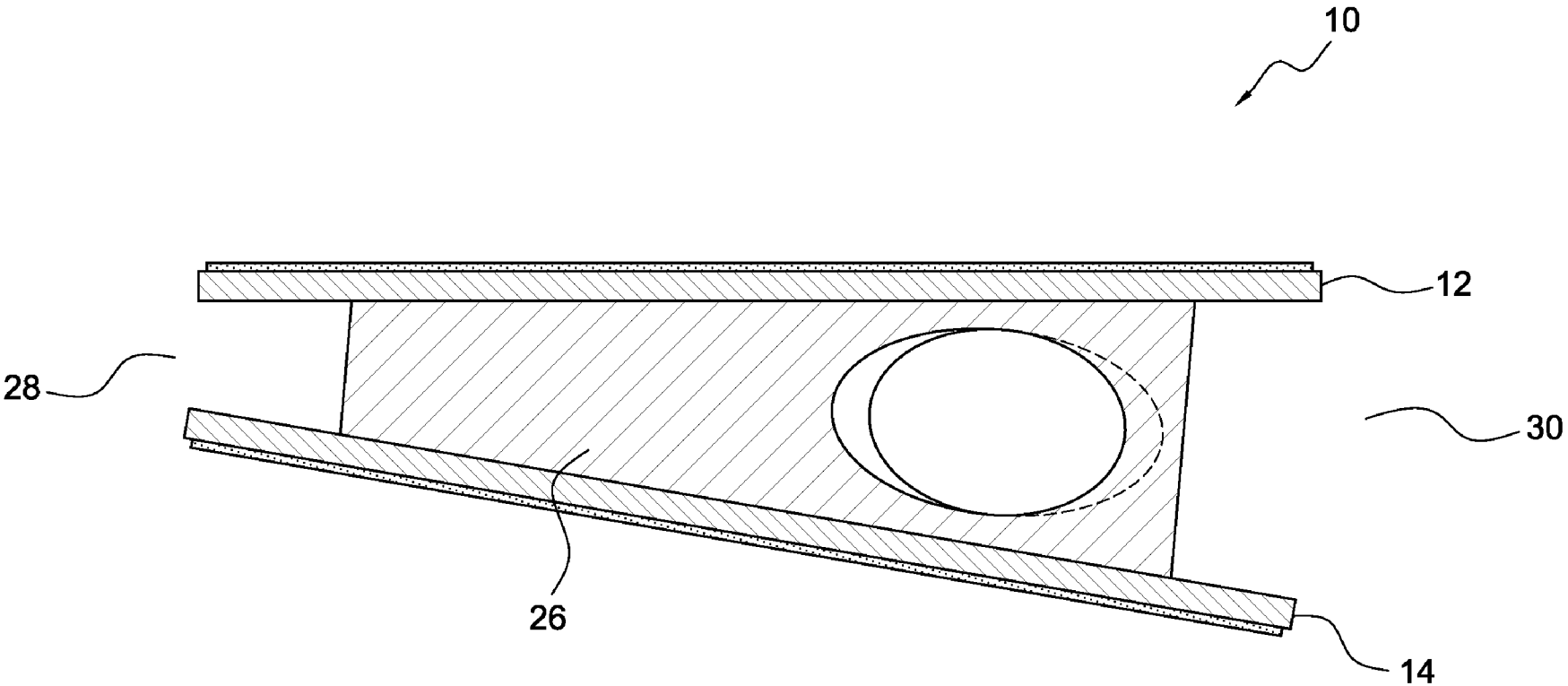
FIG. 2 is a side cross-sectional view of the paddle shown in FIG. 1.

The members 12, 14 are connected by the mounting structure 26 which extends transversely between the spaced lateral members on the interior side opposite the striking surfaces 22, 24 and the mounting structure 26 is longitudinally oriented. In the preferred embodiment, the mounting structure 26 is contoured from a fingertip end 28 to a wrist end 30 such that the spaced lateral members 12, 14 diverge forming a V-shaped guide as shown in FIG. 2.

The height of the mounting structure 26 is configured to a provide a glove-like fit to the player's hand 16 to allow for fast and easy transition from forehand to backhand and to provide more direct control of the ball during play. The longitudinal oriented mounting structure 26 is offset laterally of the centerline 32 of the members 12, 14 to provide a grip for the player's thumb 34 as shown in FIG. 3. The player's hand 16 glides in between the lateral members 12, 14 to hold the paddle 10.

In a preferred embodiment, the spaced lateral members 12, 14 are fastened to the mounting structure 26 using glue/adhesive, although other methods of attachment such as screws, dowels, rivets and epoxies can be used and are considered within the scope of the invention.

An ergonomically shaped thumb grip 38 is integral with the mounting structure 26 at the wrist end 30 of the paddle 10 where the player's hand 16 is received as shown in FIG. 3. In the preferred embodiment, the thumb grip 38 is preferably molded into the mounting structure 26, although the invention does not preclude a separable thumb grip (see FIG. 5) made of different materials such as plastic, rubber, leather, fabric or metal. In the preferred embodiment, the thumb grip 38 is sized to accommodate players' thumbs 34 of different sizes.

The overall length of the paddle 10 may conveniently be about 7½ inches (190 mm) and the overall width may conveniently be about 6¼ inches (150 mm) with the area of the spaced lateral members 12, 14 being sufficient to extend completely over the player's hand 16. The height of the paddle 10 at the fingertip end 28 may conveniently be about ¾ inches (20 mm) and at the wrist end 30, about 2 inches (50 mm). The paddle 10 is contoured such that the sides of the lateral members 12, 14 and fingertip end 28 are convex in appearance and the wrist end 30 is concave, or arched, in appearance. The convex sides of the lateral members 12, 14 and the concave arched relief at the wrist end 30 meet at their edges to form a point. The concave arched relief at the wrist end 30 may conveniently be approximately ¾ inch (20 mm) from the base of the lateral members 12, 14 to the peak of concavity located at the centerline 32. Each lateral member 12 and 14 suitably approximate a conventional, single table tennis or ping pong paddle in size, shape and material.

Figure 4:
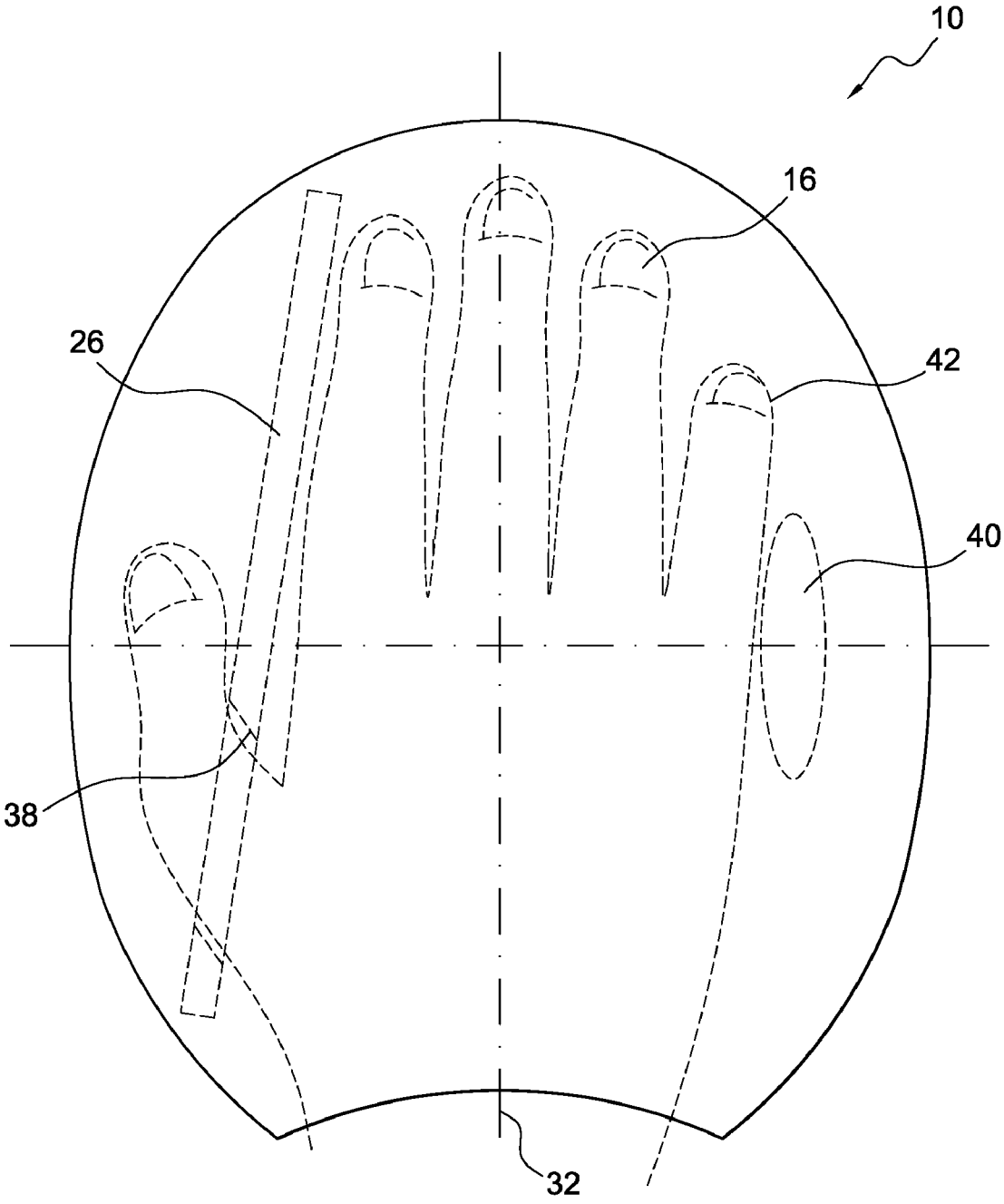
FIG. 4 is a top view of an alternate embodiment of the paddle shown in FIG. 1 with a pinky stop member of elliptical design.

FIG. 4 shows another embodiment of the paddle 10 which includes a pinky stop 40 proximately located offset laterally of the centerline 32 of the spaced lateral members 12, 14 opposite the mounting structure 26. The pinky stop 40 is of an elliptical shape and provides an additional constraint feature for the player's hand 16 opposite the thumb grip 38 and nearest the pinky finger 42.

Figure 5:
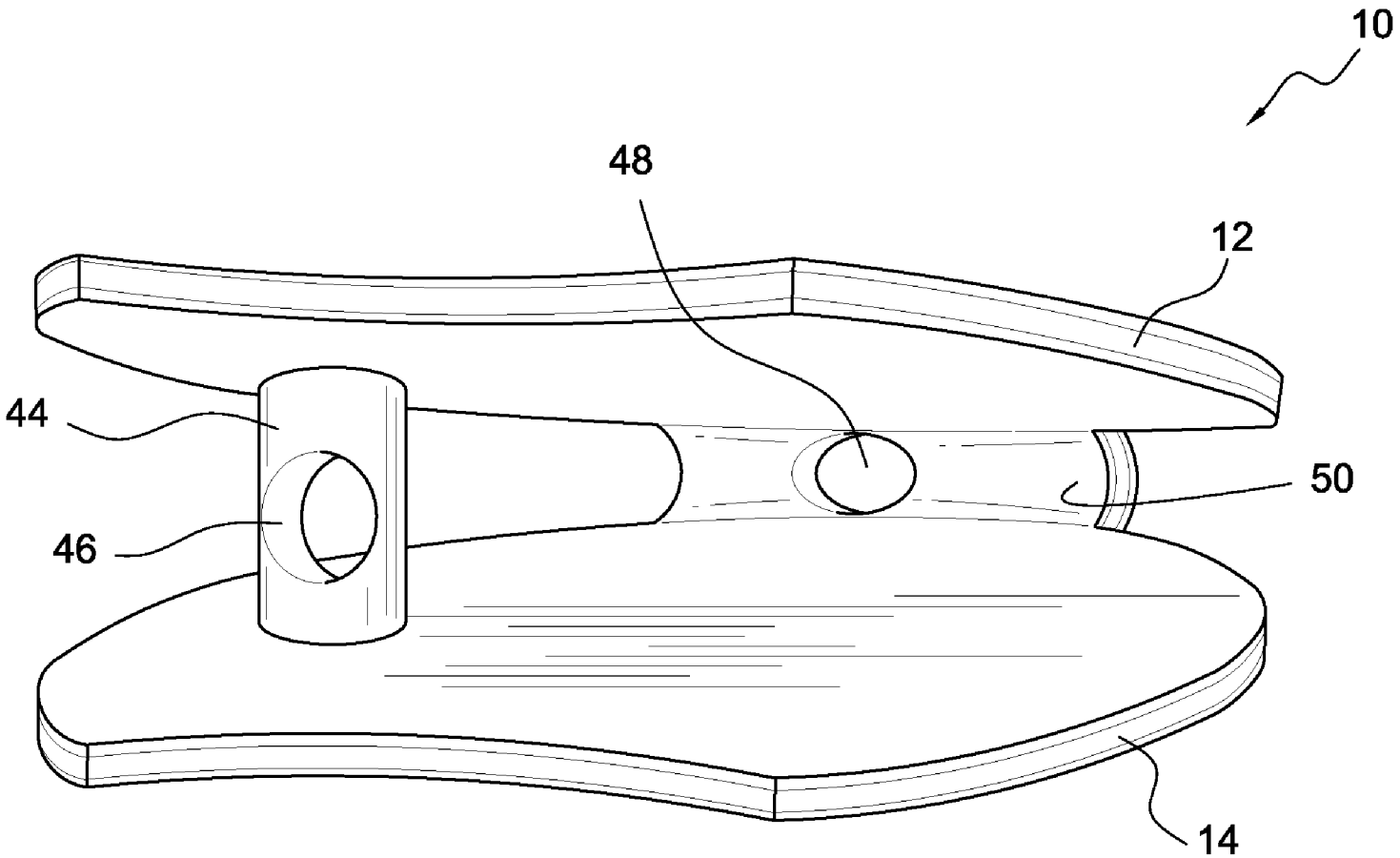
FIG. 5 is a perspective view of an alternate embodiment of the paddle shown in FIG. 1, showing a single-piece paddle.

FIG. 5 shows a further embodiment of the paddle 10 in which the spaced lateral members 12, 14, thumb grip 44 with thumb hole 46 and the transversely oriented mounting structure 50 are manufactured as a single unit using a method such as an injection molded plastic, a rubber process or molded carbon fiber, wood or metal. A thumb hole 46 is preferably molded directly into the thumb grip 44 for receiving the player's thumb 34. FIG. 3, to enhance the player's grip. A finger hole 48 is proximately located in a mounting structure 50 opposite the end where the player's hand 16 is received into the paddle to allow the players finger to protrude through the mounting structure 50 to enhance the player's trip.

Figure 6:
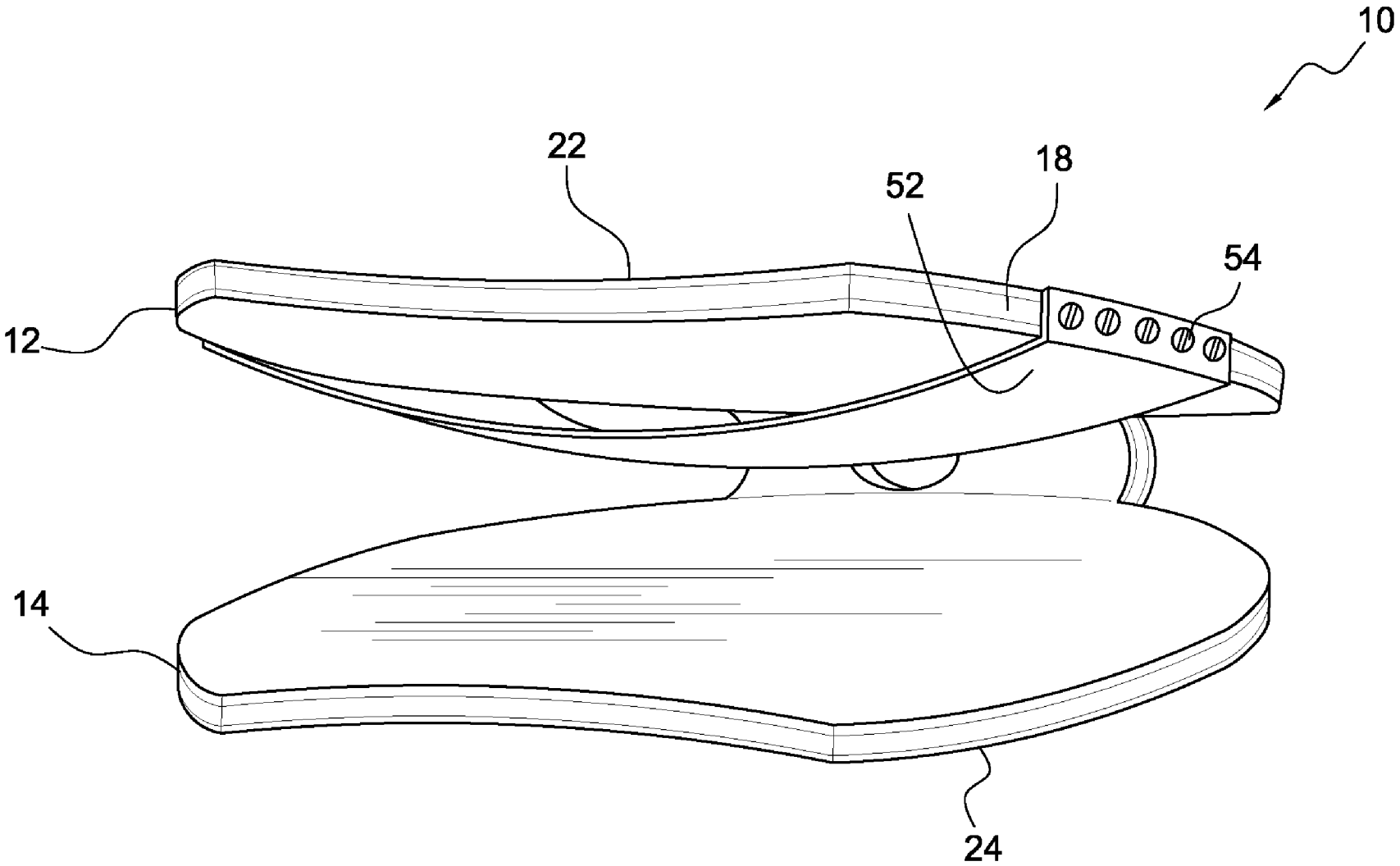
FIG. 6 is a perspective view of an alternate embodiment of the paddle shown in FIG. 5 with a hand grip.

FIG. 6 shows a still further embodiment of the single-piece paddle 10 in which a hand grip 52 is proximately located on the interior side of one of the spaced lateral members 12, 14 opposite the striking surfaces 22, 24. The hand grip 52 is sized to accommodate players' hands 16 of different sizes. The hand grip 52 is preferably a leather band; although other fabrics and materials such as elastic are considered within the scope of the invention. In the preferred embodiment, the hand grip 52 is fastened to the outer circumference 18 of the spaced lateral members 12, 14 using tacks 54. Other methods of attachment such as staples, adhesives or epoxy resin are viable means of fastening the hand grip 52 to the space lateral member 12, 14. An integral hand grip (not shown) molded directly into the spaced lateral members 12, 14 during the fabrication process is also considered within the scope of the invention. Alternately, a replaceable hand grip (not shown) attached to the spaced lateral member 12, 14 by means of a slip fit joint or a hook and loop fastener means is considered within the scope of the invention.

Figure 7:
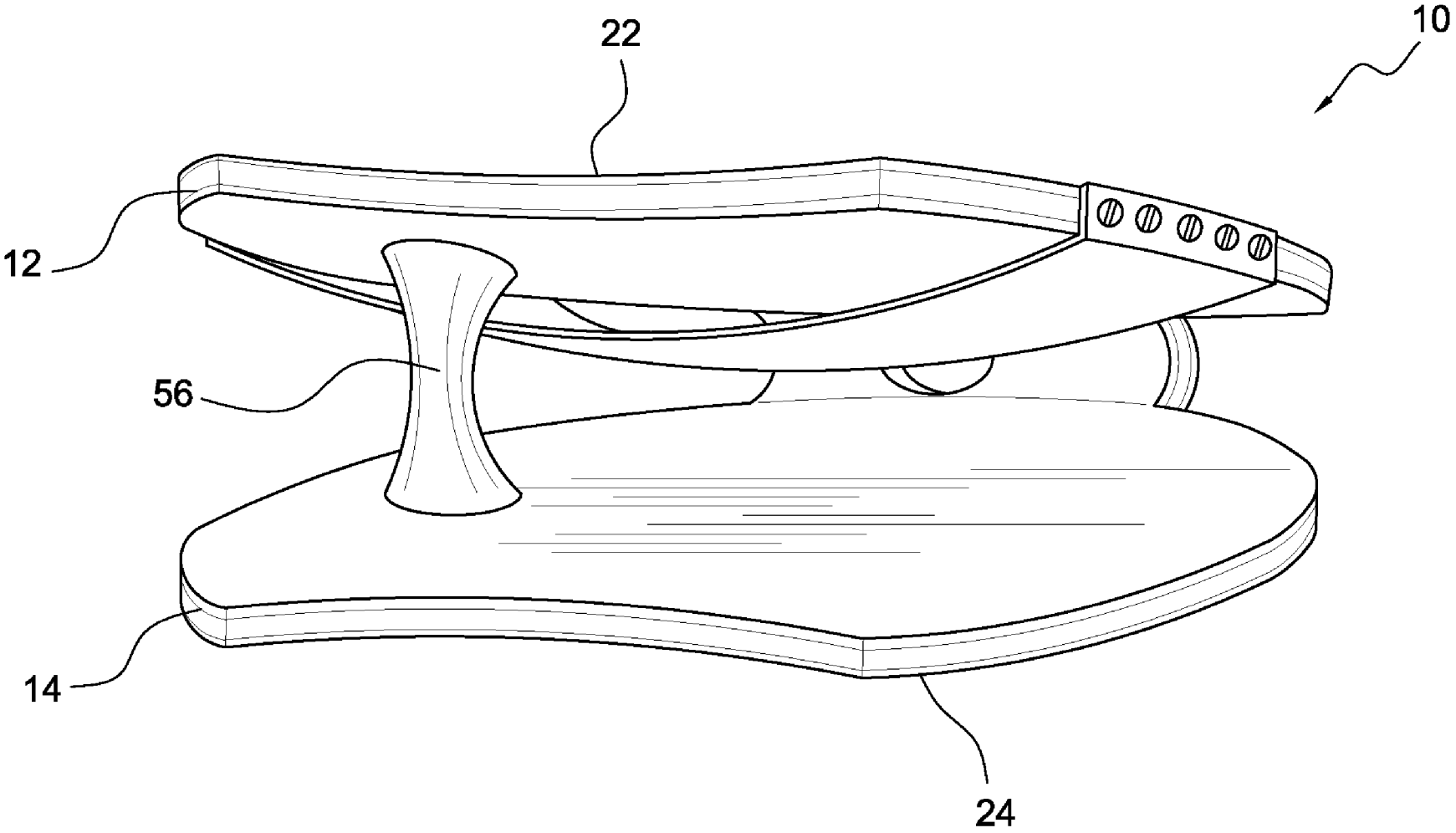
FIG. 7 is a perspective view of an alternate embodiment of the paddle shown in FIG. 6 with a thumb grip dowel.

FIG. 7 shows a further embodiment of the single-piece paddle 10 in which an ergonomically shaped thumb grip 56 connects the lateral members 12, 14 on the interior side opposite the striking surface 22, 24 to connect the lateral members 12, 14 and is proximately located at end of paddle where the player's hand 16 is received. The thumb grip 56 is preferably a molded dowel made of the same material as the spaced lateral members 12, 14 although the invention does not preclude different materials such as metal, plastic, carbon fiber, rubber or epoxy resin. In the preferred embodiment, the thumb grip 56 is molded integrally with spaced lateral members 12, 14 during the fabrication process. Alternatively, a separable thumb grip, which is fastened to the spaced lateral members 12, 14 using screws, dowels, rivets, adhesives and epoxies, is considered within the scope of this invention.

Figure 8:
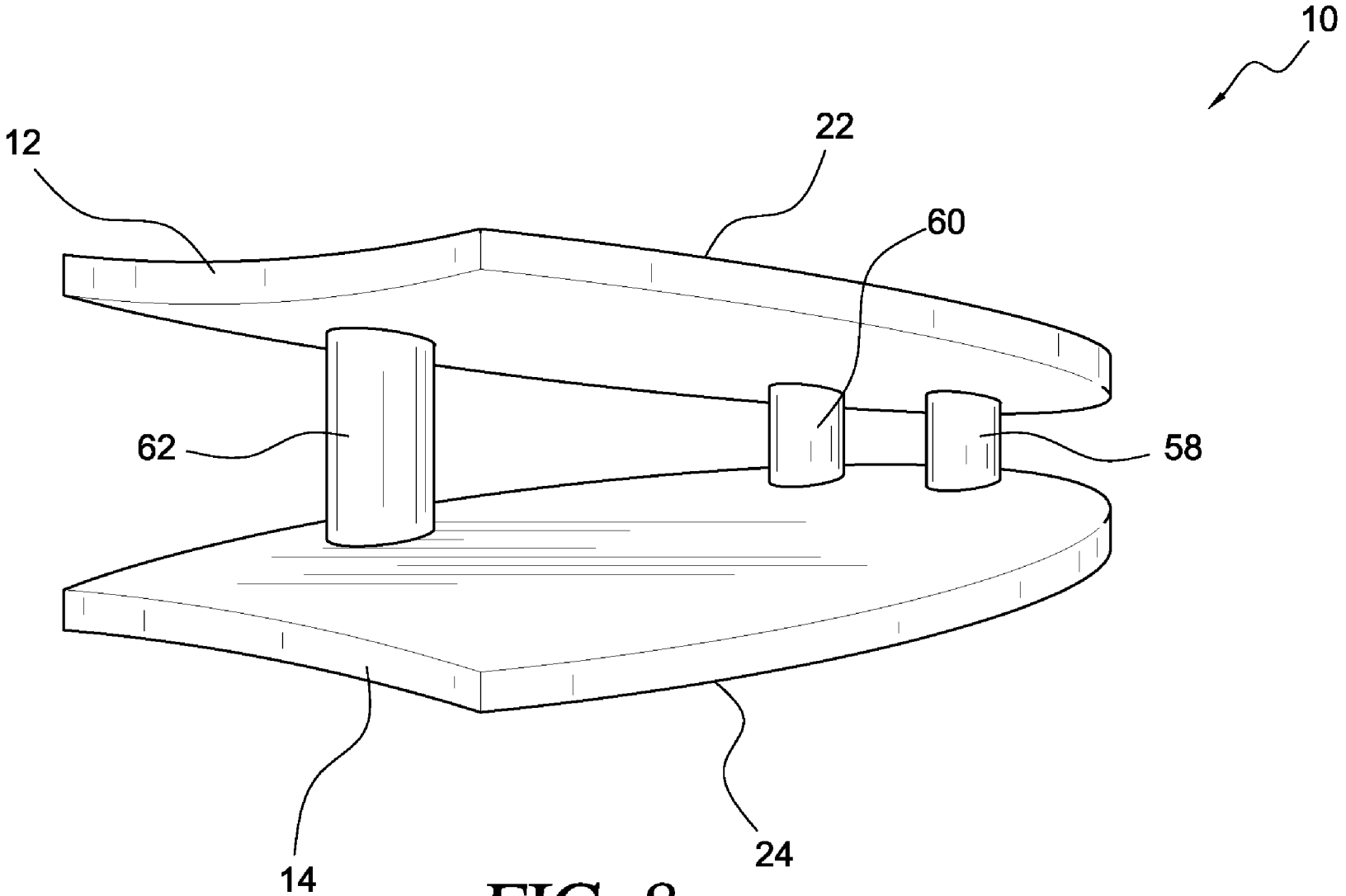
FIG. 8 is a perspective view of an alternate embodiment of the paddle shown in FIG. 1.

FIG. 8 illustrates another embodiment of the invention wherein the paddle 10 is comprised of a first lateral member 12 and a second lateral member 14 which are connected by mounting structures 58, 60 extending transversely between the spaced lateral members on the interior side opposite the striking surfaces 22, 24. The mounting structures 58, 60 are preferably wooden dowels proximately located at the end of the paddle 10 opposite the end where the player's hand 16, FIG. 3, is received, although the invention does not preclude the mounting structures 58, 60 from being made of different materials such as plastic, rubber or metal. A thumb grip 62 connects the lateral members 12, 14 on the interior side, opposite the striking surfaces 22, 24 and is proximately located at the end of the paddle 10 where the player's hand 16 is received. The thumb grip 62 is offset laterally of the centerline 32, FIG. 3 of the members 12, 14 to provide a grip for the player's thumb 34, FIG. 3. The thumb grip 62 is preferably a wooden dowel, although the invention does not preclude different materials such as plastic, rubber or metal. In the preferred embodiment, the thumb grip 62 is taller than die mounting structures 58, 60 such that the spaced lateral members 12, 14 diverge forming a V-shaped guide. The height of the thumb grip 62 and the mounting structures 58, 60 are configured to provide a glove-like fit to the player's hand 16.

Figure 9:
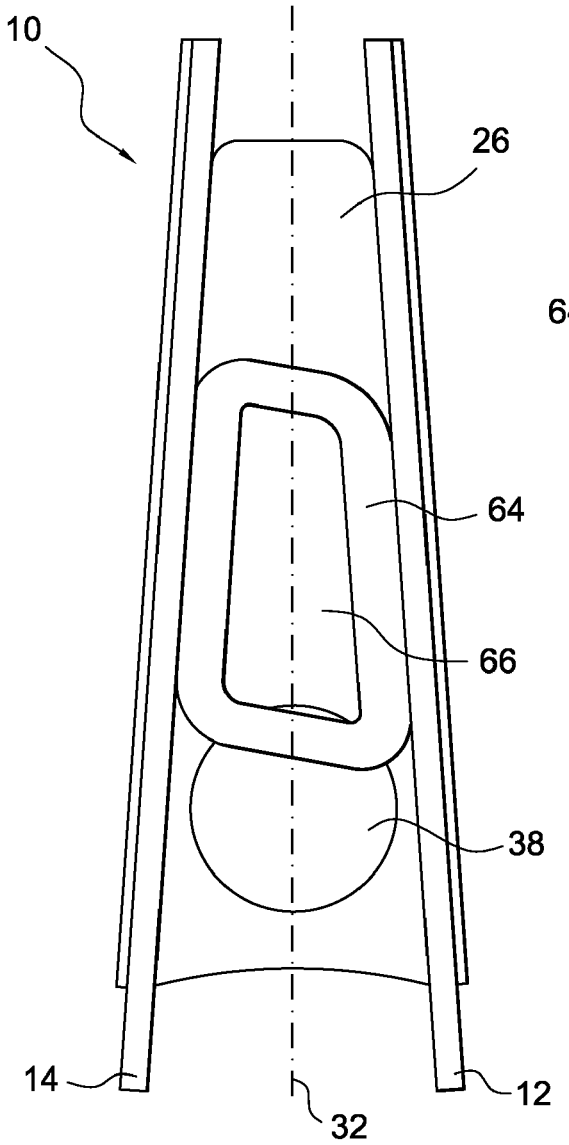
FIG. 9 is a side cross-sectional view of an alternate embodiment of the paddle shown in FIG. 1 with a pinky stop of rectangular design.
Figure 10:
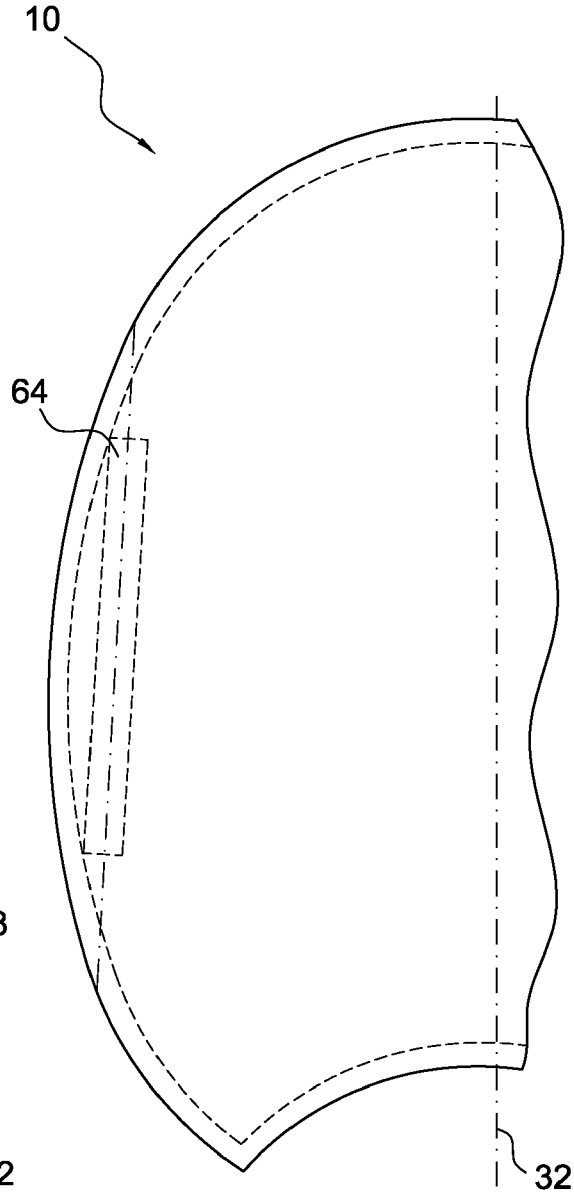
FIG. 10 is a top view of an alternate embodiment of the paddle shown in FIG. 1 with a pinky stop of rectangular design.

FIGS. 9 and 10 show yet another an alternate embodiment of the paddle which includes a pinky stop 64 proximately located offset laterally of the centerline 32 of the space lateral members 12, 14 opposite the mounting structure 26. The pinky stop 64 is of a rectangular shape and provides an additional constraint feature for the player's hand 16 opposite mounting structure 26 and thumb grip 38 and nearest the pinky finger 42, shown in FIG. 4. The rectangular pinky stop 64 has a cutout 66 in its sidewall, FIG. 9, thus forming a hollow stop. Alternatively, the rectangular pinky stop 64 may not have a cutout allowing for the addition of the manufacture's name and/or insignia, a sponsor's name and/or insignia or other indicia.

While the paddles have been described in conjunction with table tennis, the paddles, in accordance with the invention, are of suitable dimensions and materials and may be employed in many of the racquet and paddle games now conventional.

What is claimed is:

1. A paddle comprising:

a pair of spaced lateral members, spaced proximately equivalent to a height of a human hand from a palm to a back of the hand; and a mounting structure fixed to and extending transversely between the spaced lateral members for connecting the spaced lateral members, the mounting structure having a thumb grip, the thumb grip being an angled elliptical opening in the mounting structure to receive a player's thumb.

2. The paddle of claim 1, wherein the pair of spaced lateral members have longitudinal axes which diverge forming a V-shaped guide.

3. The paddle of claim 1, wherein the pair of spaced lateral members includes an outer circumference and an arched relief at an end closest to where a player's hand is received.

4. The paddle of claim 1, wherein the pair of spaced lateral members includes a pair of striking plates positioned on a surface of the spaced lateral members opposite the mounting structure.

5. The paddle of claim 1, wherein the pair of spaced lateral members and the mounting structure are made from a material selected from the group of wood, steel, aluminum, plastic, carbon fiber, rubber or epoxy resin.

6. The paddle of claim 1, wherein the mounting structure is offset laterally of a centerline of the spaced lateral members.

7. The paddle of claim 1, wherein the height of the mounting structure is configured to provide a glove-like fit to a player's hand.

8. The paddle of claim 1, wherein the mounting structure is fixed to the pair of spaced lateral members by means of fixing means selected from the group screws, dowels, rivets, adhesive or epoxy resin.

9. A paddle comprising:

a single unit which includes a pair of spaced lateral members, spaced proximately equivalent to a height of a human hand from a palm to a back of the hand;

a mounting structure extending transversely between the spaced lateral members for connecting the spaced lateral members; and a hand grip fixed to and proximately located on an interior side, opposite a striking surface, of only one of the spaced lateral members, opposite a striking surface, wherein the hand grip is fixed to an outer circumference of the one of the lateral spaced members.

10. The paddle of claim 9, wherein the hand grip is made from leather or an elastic material.

11. The paddle of claim 9, wherein the hand grip is fixed to one of the lateral members by means of tacks, staples, adhesive, epoxy resin, a slip fit joint or a hook and loop fastener.

12. A paddle comprising:

a pair of spaced lateral members, spaced proximately equivalent to a height of a human hand from a palm to a back of the hand;

a mounting structure extending transversely between the spaced lateral members for connecting the spaced lateral members, the mounting structure having a thumb grip, the thumb grip being an angled elliptical opening in the mounting structure to receive a player's thumb; and a pinky stop extending transversely between the spaced lateral members for connecting the spaced lateral members, the pinky stop being positioned such that when a player's hand strikes the pinky stop, the thumb is ready for reception by the thumb grip.

13. The paddle of claim 12, wherein the pair of spaced lateral members have longitudinal axes which diverge forming a V-shaped guide.

14. The paddle of claim 12, wherein the pair of spaced lateral members includes an outer circumference and an arched relief at the end closest to where the player's hand is received.

15. The paddle of claim 12, wherein the pair of spaced lateral members includes a pair of striking plates positioned on a surface of spaced lateral members opposite the mounting structure and the pinky stop.

16. The paddle of claim 12, wherein the pinky stop is elliptically-shaped.

17. The paddle of claim 12 wherein the pinky stop is offset laterally of a centerline of members to provide a grip for the player's thumb.

18. The paddle of claim 12, wherein the height of the pinky stop and the mounting structure are configured to provide a glove-like fit to the player's hand.

19. The paddle of claim 12, wherein the spaced lateral members, the mounting structure and the pinky stop are manufactured as a single unit.

* * * * *